US008628209B2

(12) United States Patent
Shew

(10) Patent No.: US 8,628,209 B2
(45) Date of Patent: Jan. 14, 2014

(54) LIGHT ASSEMBLY

(75) Inventor: Jeremy M. Shew, Swartz Creek, MI (US)

(73) Assignee: Larry N. Shew, Highland, MI (US)

( * ) Notice: Subject to any disclaimer, the term of this patent is extended or adjusted under 35 U.S.C. 154(b) by 294 days.

(21) Appl. No.: 12/955,880

(22) Filed: Nov. 29, 2010

(65) Prior Publication Data

US 2011/0128725 A1 Jun. 2, 2011

Related U.S. Application Data

(60) Provisional application No. 60/283,099, filed on Nov. 28, 2009.

(51) Int. Cl.
*F21L 4/02* (2006.01)

(52) U.S. Cl.
USPC ..... 362/183

(58) Field of Classification Search
USPC ..... 362/157, 183
See application file for complete search history.

(56) References Cited

U.S. PATENT DOCUMENTS

| | | | | |
|---|---|---|---|---|
| 2002/0024806 | A1* | 2/2002 | Petzl et al. | 362/184 |
| 2005/0135107 | A1* | 6/2005 | Currie et al. | 362/382 |
| 2007/0223996 | A1* | 9/2007 | Green et al. | 404/9 |
| 2010/0020527 | A1* | 1/2010 | Fiermuga | 362/20 |

* cited by examiner

*Primary Examiner* — Anh Mai
*Assistant Examiner* — Hana Featherly
(74) *Attorney, Agent, or Firm* — L.C. Begin & Associates, PLLC

(57) ABSTRACT

A light assembly includes a housing containing at least one solid state lighting device. The solid state lighting device electrically communicates with an AC energy source in a known manner. At least one photovoltaic cell is connected to an inner wall of the housing adjacent to the solid state lighting device whereby the photovoltaic cell absorbs radiative energy from the solid state lighting device. At least one battery pack derives energy from the artificial light of the lighting device, by and through the photovoltaic cell. One or more LED lights, or an LED array, are contained within the housing, and electronically communicate with the battery pack. An actuation sensor activates a switching means to energize the LED light (s) with DC power from the battery pack.

7 Claims, 17 Drawing Sheets

LIGHT ASSEMBLY

CROSS-REFERENCE TO RELATED APPLICATIONS

This application claims the benefit of U.S. Provisional Application Ser. No. 61/283,099 filed on Nov. 28, 2009.

TECHNICAL FIELD

The present invention relates to light assemblies containing solid state lighting, and more particularly, to standard light assemblies incorporating novel night-lighting and/or emergency-lighting feature(s).

BACKGROUND OF THE INVENTION

Lighting configurations or assemblies have typically been manufactured with specific functionality contemplated in any respective design. For example, standard lighting assemblies, such as fluorescent troffer/lighting assemblies, have been designed to provide sufficient interior lighting to work comfortably with enough lighting for the activity at hand. Office, retail, and industrial applications are typical contexts wherein fluorescent light assemblies are generally employed.

In one area of solid state lighting, fluorescent light assemblies typically incorporate an elongated housing or "troffer" that houses the fluorescent light tubes, and the electrical sockets and circuitry that interface with and support the installation of the fluorescent bulbs. The housing is designed to accommodate a plurality of fluorescent tubes and a corresponding plurality of electrical sockets that electrically communicate with the fluorescent tubes. Oftentimes, the "troffer" contains a longitudinal compartment formed down the middle of the troffer, for housing of electrical wiring of the lighting assembly. On either side of the longitudinal compartment, one or more fluorescent bulbs or tubes are arrayed in parallel juxtaposition to the longitudinal compartment, each tube having a first and a second end cap with typically two conductive prongs on each end cap. To install the fluorescent tube, the two prongs of each end cap are fitted within two corresponding female cavities on a corresponding socket. Once installed, the sockets provide electrical communication to the fluorescent tubes/bulbs and also provide a structural support for installation of each bulb. To optimize the raw material costs, the overall configuration within the housing has over time been optimized to consolidate the space necessary for housing of the internal constituents. As a result, very little space is available for any new or additional constituents within the housing. Although fluorescent troffers have been described for purposes of illustration, many standard solid state light assemblies are also designed to eliminate raw material excess and the costs associated with that excess. As a result, the likelihood of retrofitting existing assemblies as described herein is minimal if non-existent.

Other light assemblies commercially available include night-lighting assemblies and emergency-lighting assemblies. Night lights are generally configured to provide subdued lighting and therefore require reduced energy requirements as compared to standard solid state light assemblies. As a result, night light assemblies have typically been provided as separate light assemblies given the distinct reduction in energy requirements and given the distinct functional requirements, as compared to standard lighting for example. In view of the current design limitations in the night lights commercially available, oftentimes standard solid state lighting is energized at night during periods of reduced or no activity, at night for example. As a result, relatively large amounts of energy are expended when little or no human activity is present. As viewed from the exterior of many office buildings, for example, many offices are illuminated at night by standard solid state lighting. From an environmental standpoint, the unnecessary use of energy thereby affects the overall environmental efficiency with regard to the use of standard solid state lighting in this manner.

In the same way, emergency-lighting assemblies have also been provided as separate lighting configurations given the distinct energy and functional aspects of emergency lights. In general, emergency lights are designed to provide lighting when standard lighting fails, due to power outages for example. To that end, emergency lights typically contain a battery pack that actuates the associated emergency lighting upon a termination of AC power to the normal or standard lighting. One concern with emergency lights is the cost. The battery packs are relatively expensive. Yet another concern is the energy capacity of the battery packs. In emergency lighting currently commercially available, the emergency lighting typically lasts from one to three hours. Yet another concern is the availability or scope of the emergency lighting throughout the buildings or rooms utilizing the emergency light packs. In many cases, emergency lighting is only provided proximate to or specifically at exit points as per local building codes. As a result, many areas of the building or room, within a supermarket or grocery store floor for example, may be inadequately illuminated in the event of power outages.

In view of the various functions and energy requirements, it is an ongoing challenge to provide for various standard, night, and emergency lighting while yet improving the efficacy and environmental efficiency of the various lighting arrangements.

SUMMARY OF THE INVENTION

The above-referenced concerns are resolved by a novel lighting assembly that combines standard solid state lighting with night-lighting and/or emergency-lighting functionality. A light assembly includes a housing containing at least one solid state lighting device such as, but not limited to, a fluorescent, light-emitting diode (LED), or incandescent bulb or tube. The solid state lighting device electrically communicates with an AC energy source in a known manner. At least one photovoltaic cell is connected to an inner wall of the housing adjacent to the solid state lighting device whereby the photovoltaic cell absorbs radiative energy from the solid state lighting device without inhibiting light emanating from the light assembly. At least one battery pack electronically communicates with the photovoltaic cell, whereby energy derived from the artificial light of the solid state lighting device is shunted to one or more rechargeable batteries in the battery pack. Voltage produced by the photovoltaic cell is thereby provided as DC power to the battery pack, as converted through a rectifier circuit, for example. One or more LED lights, or an LED array, are contained within the housing, and electronically communicate with the battery pack. An actuation sensor such as, but not limited to, a photo-sensor or AC power sensor operatively communicates with the circuitry connecting the battery pack and the LED array, whereby a reduction in the ambient lighting or an absence of AC power, for example, activates a switching means to energize the LED with DC power from the battery pack or battery source.

DETAILED DESCRIPTION OF THE INVENTION

The above-referenced concerns are resolved in the use of an LED light assembly that incorporates a duel function, used to cover the ballast and AC wiring within a conventional four tube fluorescent light fixture, and a LED light assembly that operates as a night-light at night.

Figure 1:
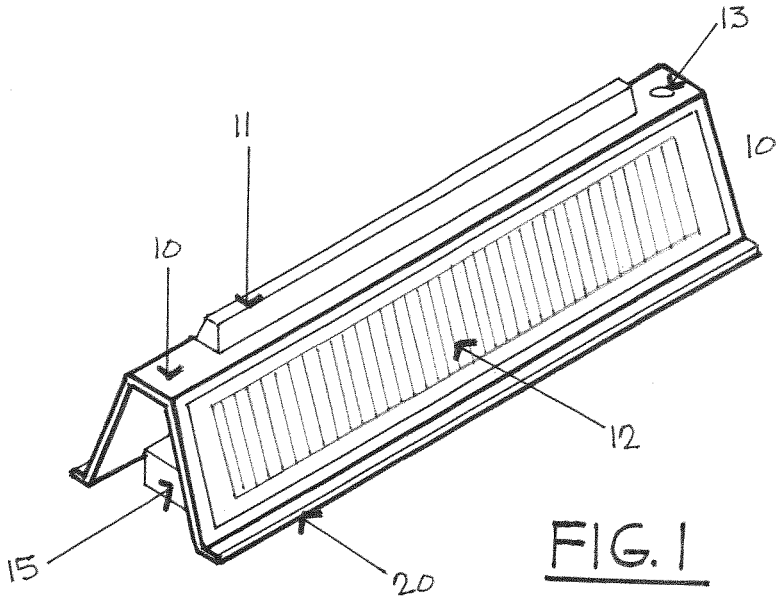
FIG. 1 illustrates a perspective view of a light assembly in accordance with the present invention.

As illustrated in FIG. 1, an LED night lighting assembly (10) that incorporates at least one or more rechargeable batteries (18), one or more photovoltaic cells (12) and circuitry (21) necessary to operate one or more LED's (17) as a night light, or to provide lighting during a power outage, may include the use of a high efficiency "Charge Pump Converter" (not shown) as the means of prolonging the operational life of all or part of the present invention.

FIG. 1 shows a LED night light assembly of the present invention designed as a ballast cover (10) within a conventional four tube fluorescent fixture (16). This LED light assembly (10) can be easily retrofitted within a new or existing fluorescent light fixture, and has the ability to operate as a night-light and/or emergency light. The operation of the LED night light assembly (10) features one or more photovoltaic cells (12) that will capture light from one or more fluorescent tubes (14) and convert the energy in that light into electrical current and use that electrical current to charge one or more batteries (18). The energy stored within the batteries will operate the LED's at night as a night-light or an emergency light during power outage. Increasing battery life may be accomplished by incorporating a high efficiency "Charge Pump Converter" and readily available circuitry by Microchip (one of many companies offering this type of circuitry). The Charge Pump Converter is an integrated circuit particularly suited for the High Efficiency LED, improving the operating life of the batteries, increasing the number of hours of operation by as much as 50-70%. The Charge Pump improves the Power Efficiency by as much as 90%, converting a +1.5 V to +15 V input to a corresponding −1.5 to −15V output using only two low-cost capacitors, eliminating inductors and their associated cost, size and EMI.

FIG. 1-8 shows the photovoltaic cells (12) of the present invention being located on the LED light assembly (10) so as not to obstruct any light being released from the light fixture (16). The photovoltaic cells (12) are located on both sides of the cover and positioned to maintain light reflection within the light fixture. After extensive testing, it was determined the optimum location of the photovoltaic cells (12) to be within 0.1-2 inches from the fluorescent tube (14). This is believed to maximize the amount of light captured and reduces the time needed to charge one or more batteries. Testing determined that the total number of photovoltaic cells would be based on two factors. First, the number of hours the light fixture is in operation during the day and secondly, the number of batteries used to operate the night light at night. This will allow the ability to calculate the photovoltaic cell area needed to fully charge all batteries within the light assembly. Increasing the area of the photovoltaic cells will help reduce the time needed to fully recharge all batteries within the light assembly.

Electric current is believed to be generated when the light from an incandescent bulb or fluorescent tube strikes the photovoltaic cells, dislodging the electrons resulting in the production of electrical current. This electrical current, within the present invention, is used as the power source to charge one or more rechargeable batteries (18), thereby providing stored energy to operate one or more LED's (17) at night as a night light assembly (10). In summary, the electrical current is stored within a battery (18) and at some point in time is supplied directly to the LED's (17) by way of a circuit board (21). After extensive testing of several name brand batteries, it was determined that the quality of the battery may optimize the operation of the LED night light assembly (10). Tests conducted using AA rechargeable battery manufactured by Duracell with 2650 mAh provided sufficient power and life to achieve over 70 hours of operation before requiring recharging of the batteries. This capacity therefore permits operation of the night light assembly within an office over a weekend when lighting is not in operation. Recharging can then take place again on Monday mornings, or other times of normal operation of standard state lighting.

As depicted in the FIG. 1-14, a fluorescent or incandescent bulb (14) is powered by a standard AC power supply (e.g. 115 VAC). When in operation, the fluorescent tubes (14) function as the primary light source within a room. Within the light assembly are one or more photovoltaic cells (12) positioned to capture and convert the light generated by a fluorescent tube (14) into electrical current to charge one or more batteries (18) within the LED light assembly (10).

Figure 2:
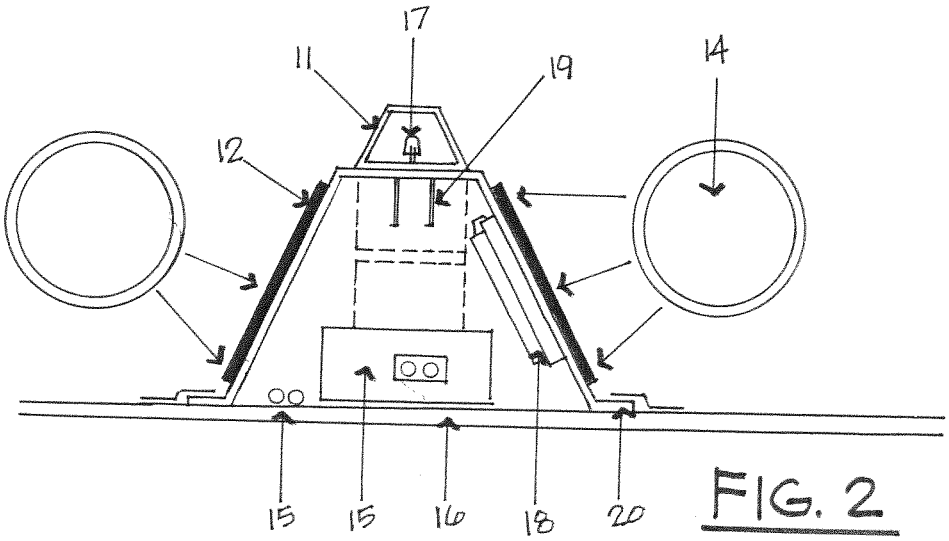
FIG. 2 illustrates a cross-section of a light assembly showing the end view in accordance with the present invention.
Figure 3:
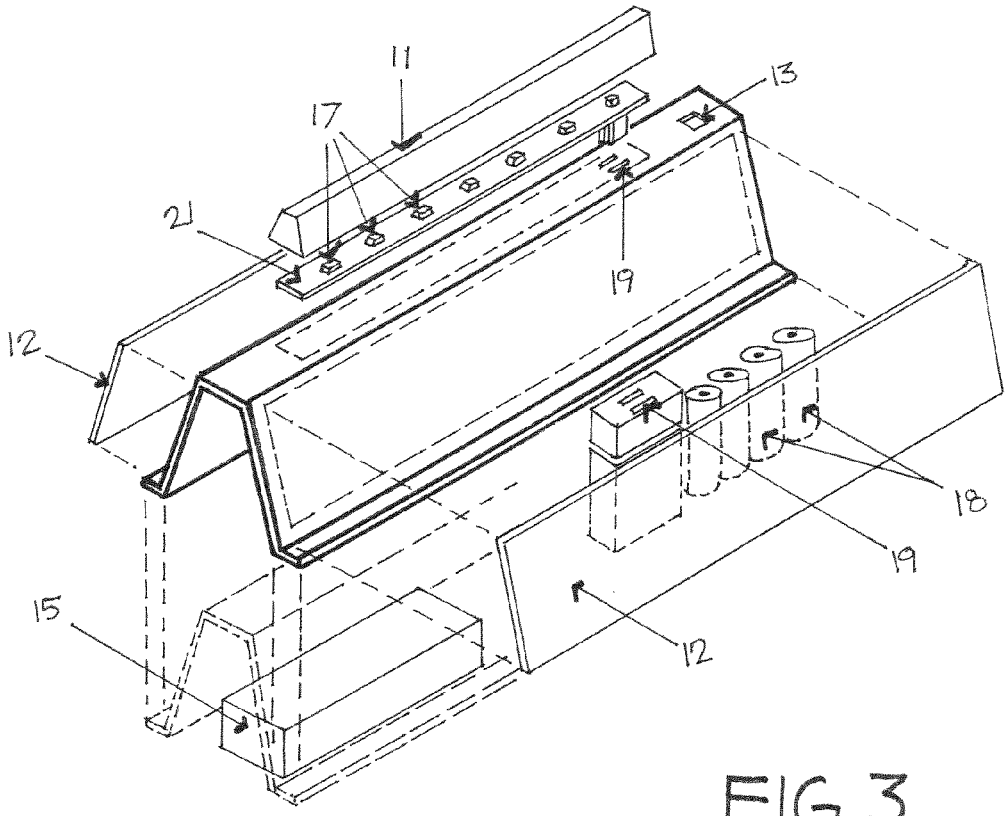
FIG. 3 illustrates an exploded view of the light assembly in accordance with the present invention.

The LED light assembly (10), in accordance with the present invention, will require no switches to turn on or off the LED light assembly. A photocell (13) will be incorporated within the present invention (see FIG. 1-21) as a light sensor and the means of turning on and off the periphery of LED lights within the light assembly (10). As the environment darkens to a predetermined lighting value, the photocell (13) essentially functions as a switch to activate the DC power to a night light subassembly within the fixture. The LED (17), as exemplified in FIGS. 1-6, preferably consists of one or more light emitting diodes (LED) (17) assembled onto a circuit board (21) electronically communicating with a DC power source by way of the photocell. FIG. 3 illustrates the backside of the present invention of a LED light assembly (10). The DC power communicates by way of a positive and negative connection (19). Plugging the LED light circuit (21) into a DC power source, in a similar fashion to an electrical plug connecting into an electrical outlet, activates a series of LED's (17). The LED's (17) may be provided in various colors, power ratings and intensities. A dimmer control (not shown) is added to help control the brightness of the LED night-light (10).

Figure 4:
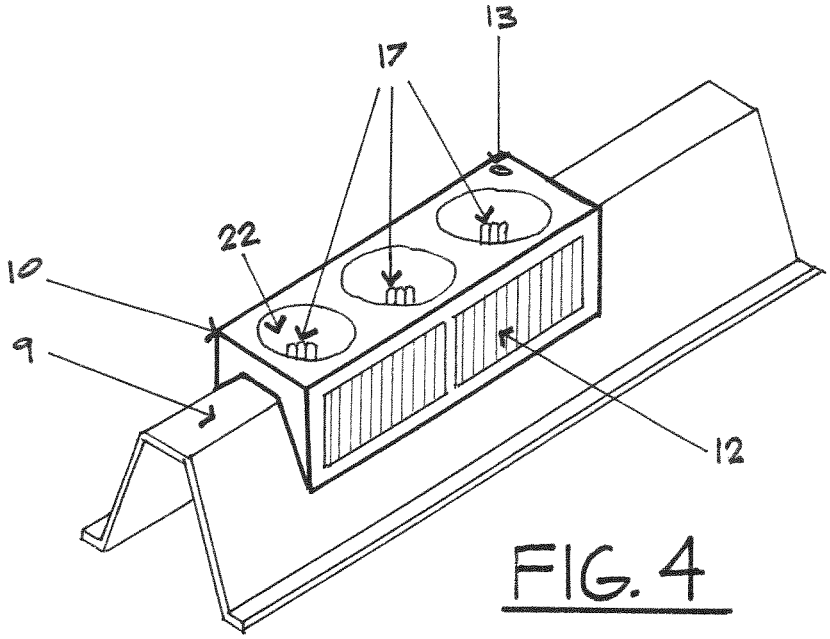
FIG. 4 illustrates a perspective view of another embodiment of a light assembly in accordance with the present invention.
Figure 5:
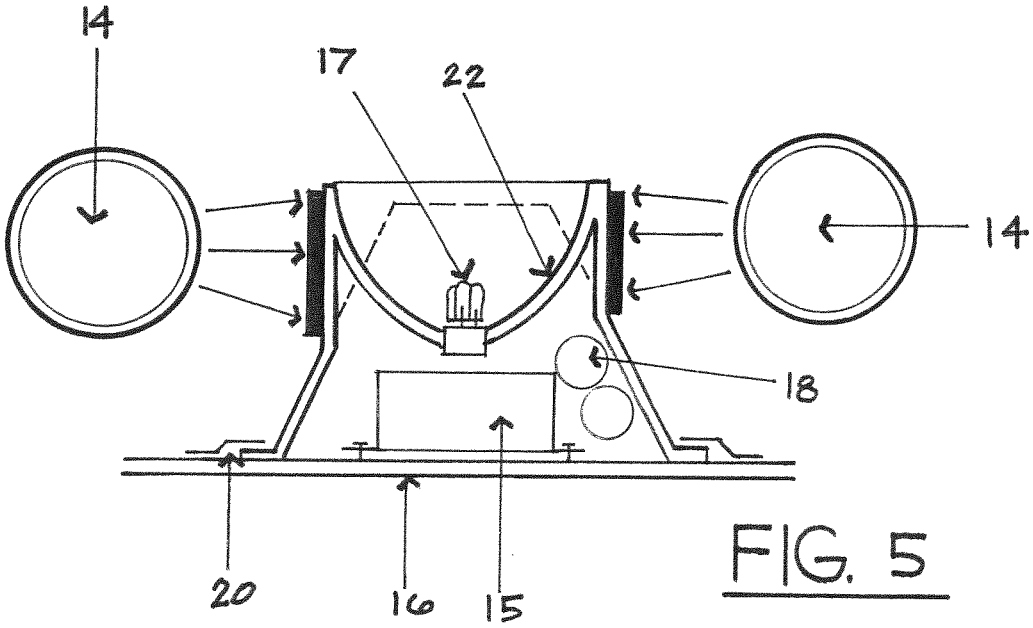
FIG. 5 illustrates an end section of another embodiment of the light assembly in accordance with the present invention.
Figure 6:
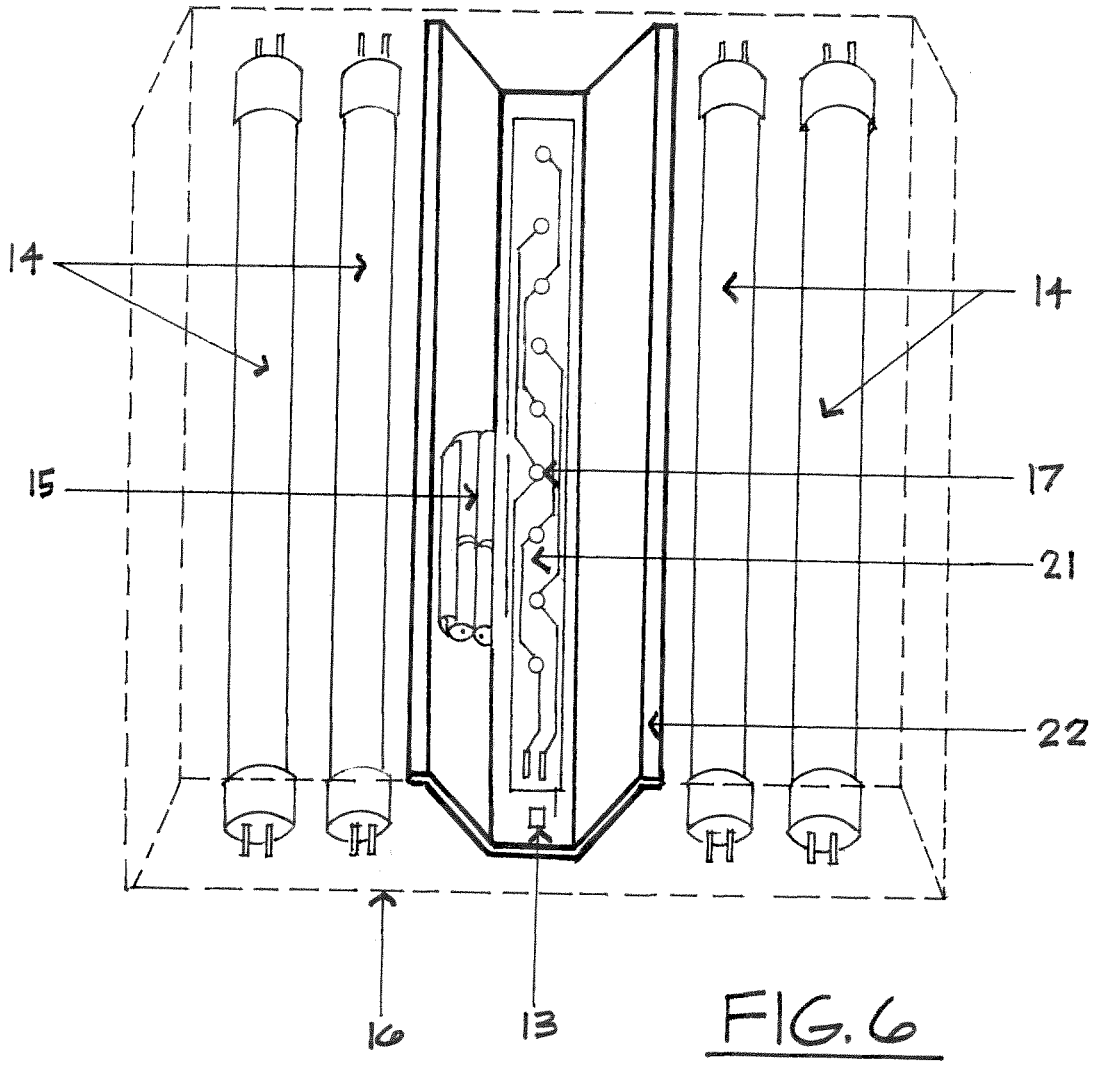
FIG. 6 illustrates a view looking into the light assembly, viewing the circuitry and components of the light assembly in accordance with the present invention.

The two most common forms of lighting, used commercially within office or retail, are two tube or four tube fluorescent light fixtures. Currently, a "night lighting function" is not available for this type of light fixture and therefore creates a perceived need and interest. FIG. 4 and FIG. 5 illustrates a light assembly (10) of embodiment that attaches directly over a ballast cover (9) within a four tube fluorescent light fixture and features a unique spot light (22) option. Fluorescent light fixtures within commercial buildings with high ceiling require special reflectors to help direct the light downward. As a means of helping to direct the LED light source downward, a special spotlight is incorporated within the light assembly. The cove (22) that holds the LED's (17), will feature a chrome or mirror interior finish to help improve reflection of the LED's. Testing confirms this would be the best solution for directing the light downward.

Figure 7:
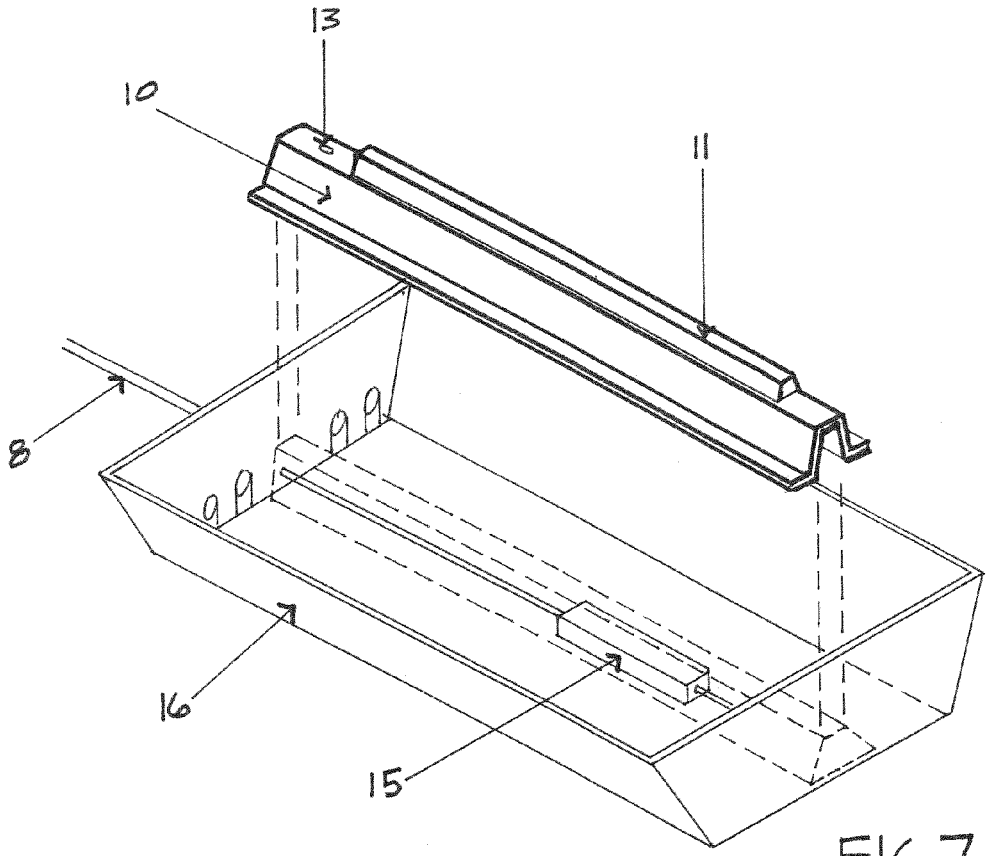
FIG. 7 illustrates an exploded view of the light assembly and a light fixture in accordance with the present invention.
Figure 8:
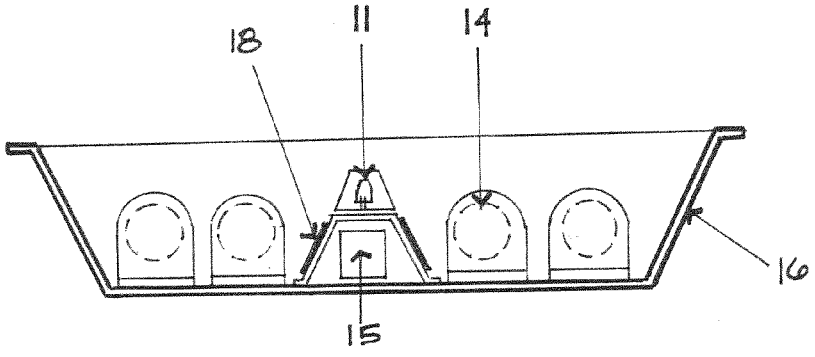
FIG. 8 illustrates an end section of the light assembly in accordance with the present invention.
Figure 10:
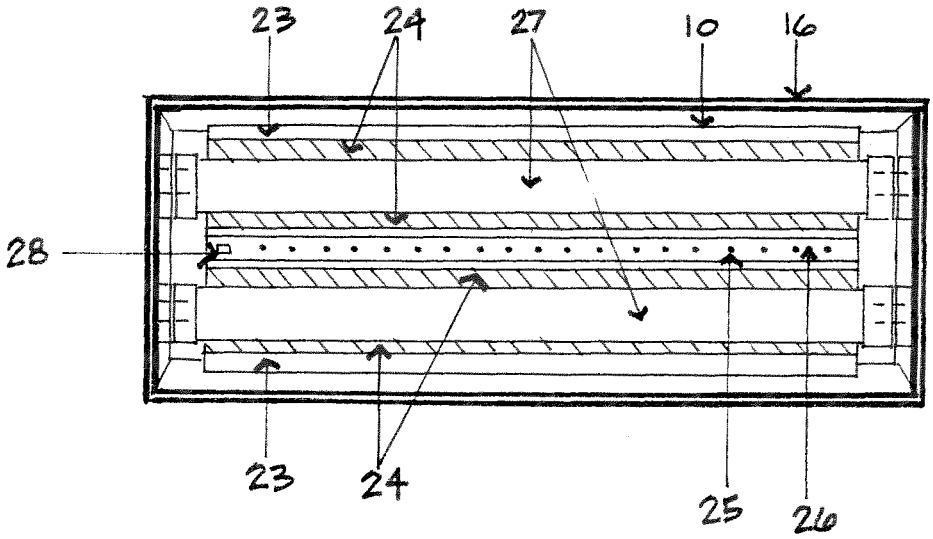
FIG. 10 illustrates a top view of another embodiment of a two tube, fluorescent light fixture in accordance with the present invention.
Figure 9:
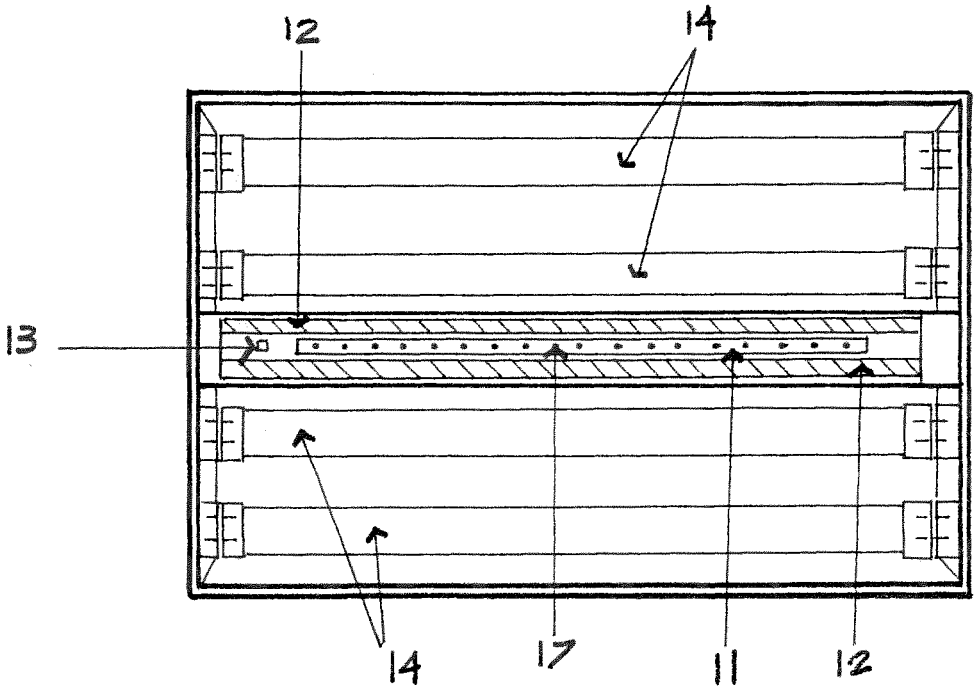
FIG. 9 illustrates a top view of a four tube, fluorescent light fixture in accordance with the present invention.
Figure 11:
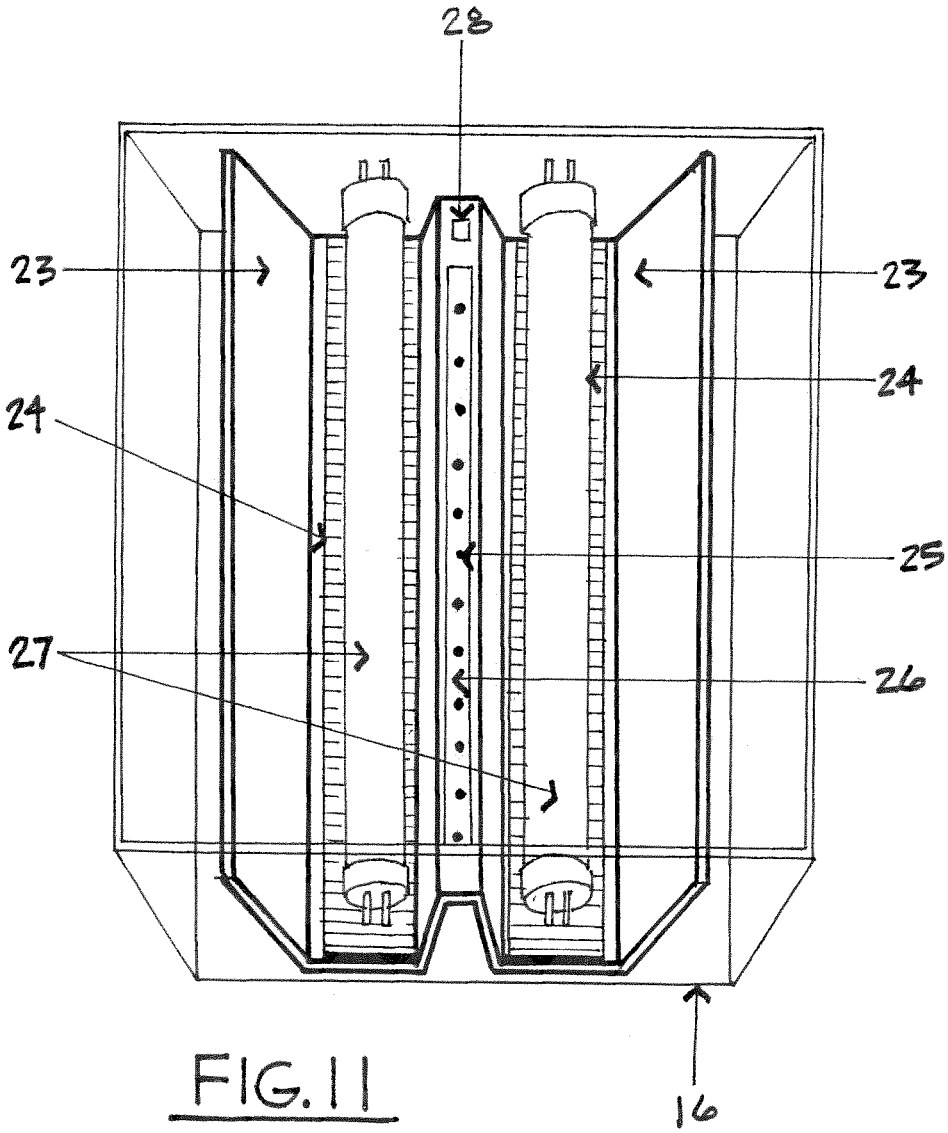
FIG. 11 illustrates a perspective view of another embodiment showing the topside of a light assembly in accordance with the present invention.
Figure 12:
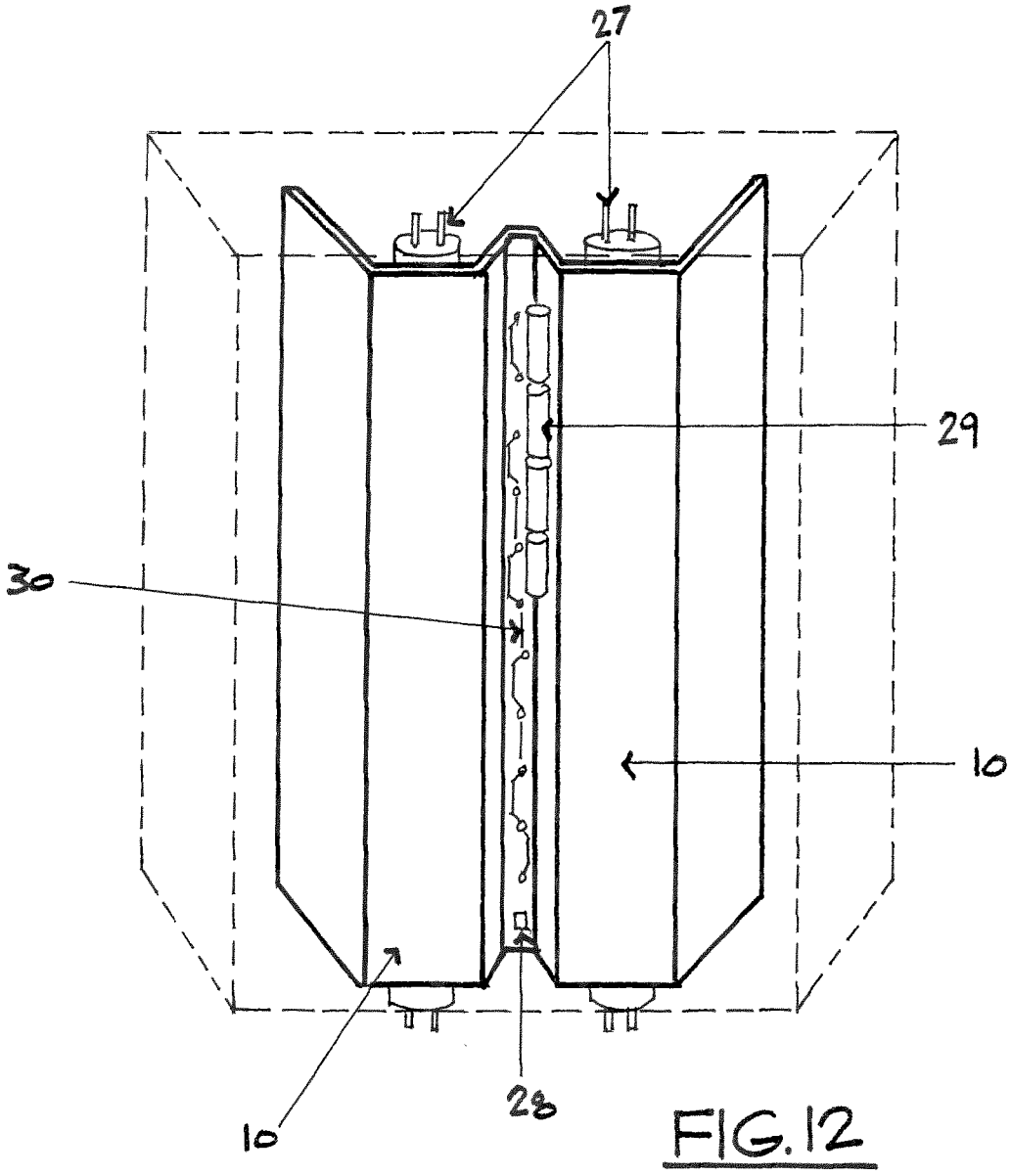
FIG. 12 illustrates a perspective view of another embodiment showing the backside of a light assembly in accordance with the present invention.
Figure 13:
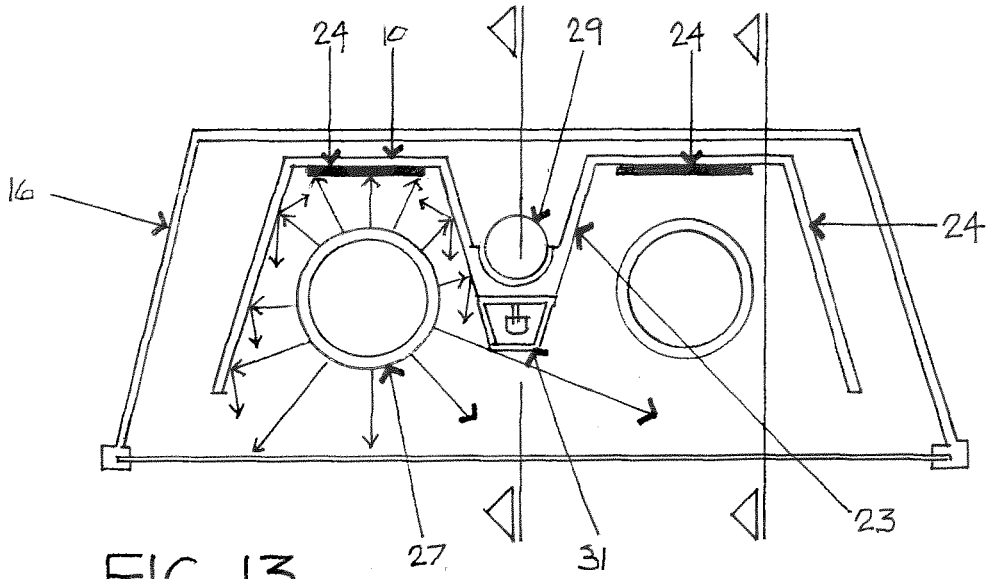
FIG. 13 illustrates a cross section view of another embodiment of a light assembly in accordance with the present invention.
Figure 14:
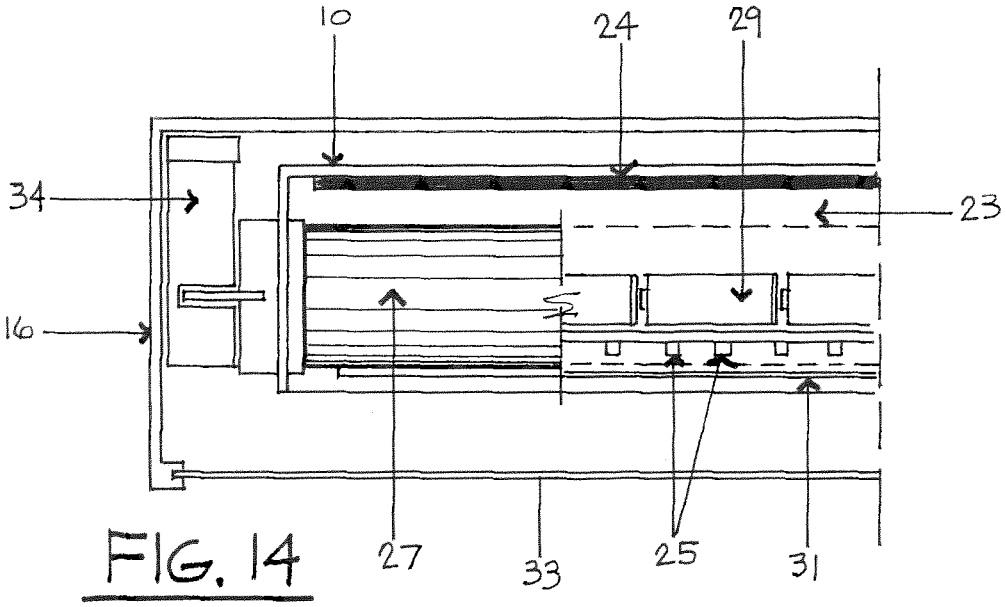
FIG. 14 illustrates a cross section view of another embodiment of a light assembly in accordance with the present invention.

FIG. 7 shows the LED light assembly (10) as a "cover", installed within a four tube fluorescent fixture (16) directly over the ballast (15) and AC wiring. The LED light assembly would function as a dual function assembly. One function acts as a cover and the second is the night light, specially designed to fit easily within a four tube fluorescent light fixture.

FIGS. 11-14 illustrates a light assembly (10) of another embodiment; a two tube fluorescent fixture (16). The light assembly shown in FIGS. 11-14 is specially designed to fit easily behind two fluorescent tubes (27) within a conventional light fixture (16). Within the light assembly are light reflecting sides (23) thereby providing reflection within the fluorescent light fixture for enhanced energy absorption by the photovoltaic cells. The present invention incorporates a strip of LED's (31) at the top of a light assembly, a photocell (28) to turn on and off the LED's, one or more photovoltaic cells (24) connected to a battery (29) providing the DC power to operate the LED's (25). All components are within a one piece light assembly. A major benefit of light assemblies of the present invention is that the DC power source requires no wire connections of any kind between the LED light assembly and the light fixture, thereby making simplifying installation and enhancing the safety thereof.

Figure 15B:
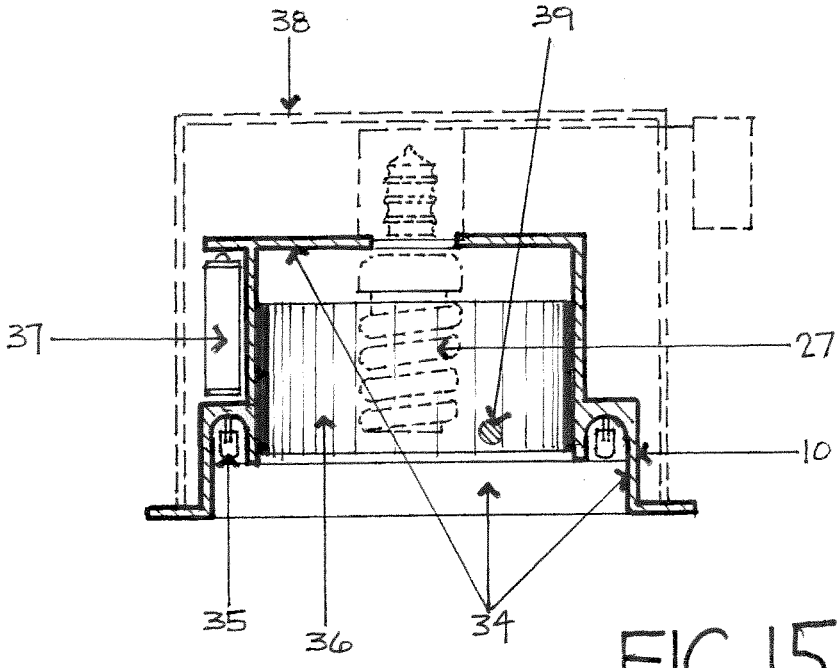
FIGS. 15*a* and 15*b* illustrates a cross section view and top view of another embodiment of a light assembly in accordance of the present invention.
Figure 15A:
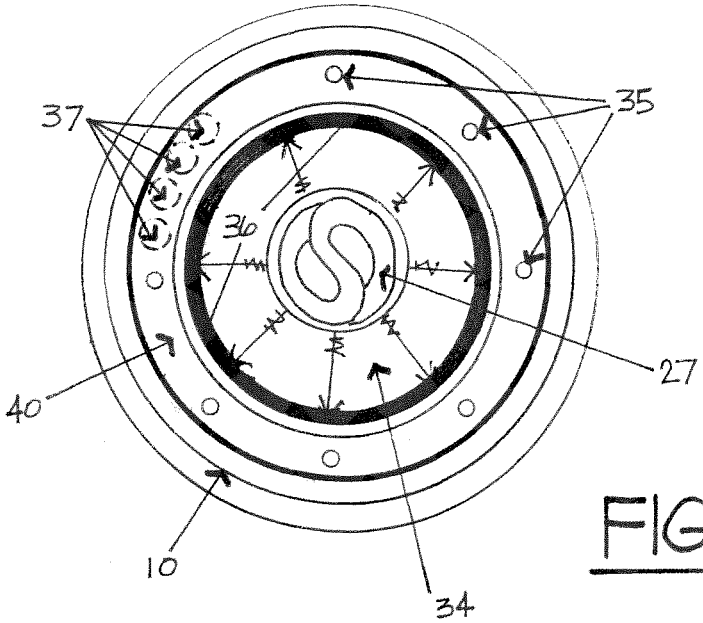
Figure 16A:
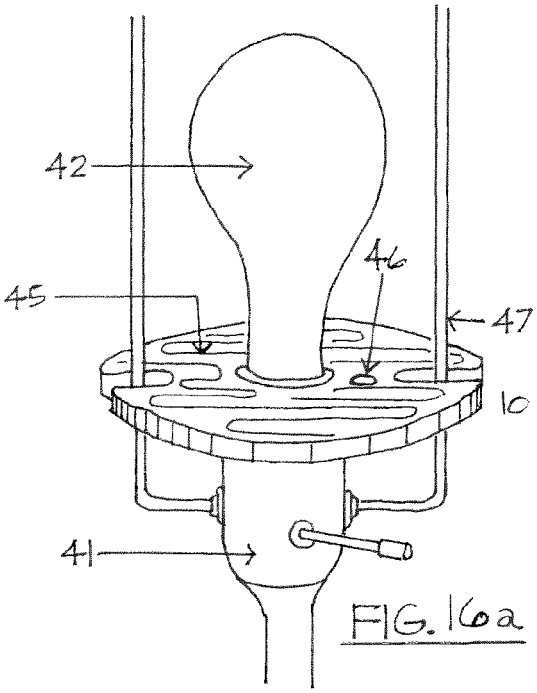
FIG. 16*a*-16*e* illustrate a perspective, cross sections, top view, and bottom view of another embodiment of a light assembly in accordance of the present invention.
Figure 16B:
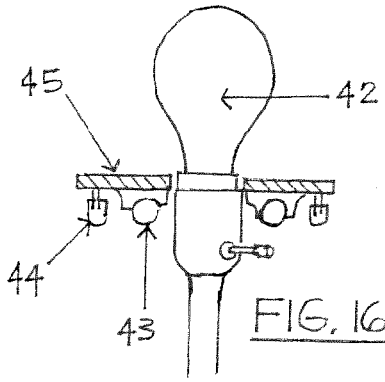
Figure 16C:
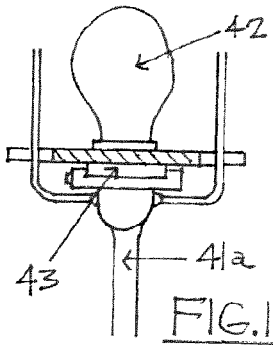
Figure 16D:
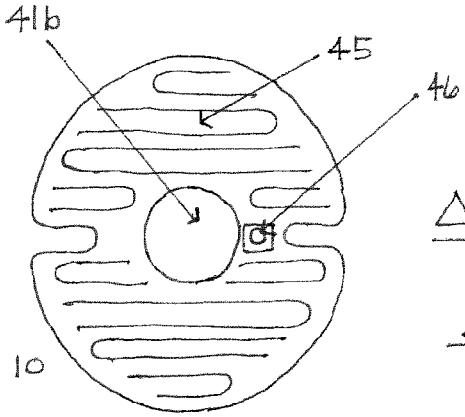
Figure 16E:
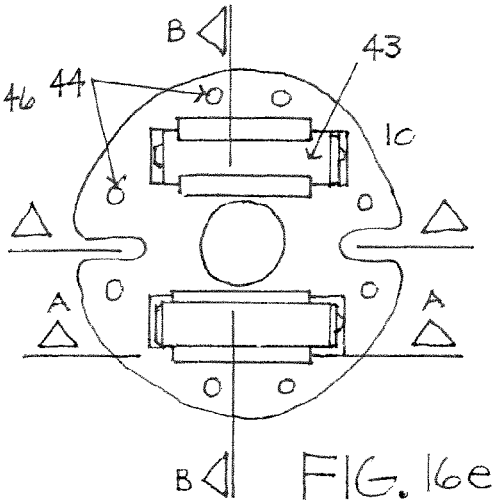

FIG. 15 illustrates another embodiment of the present invention, a commonly used recess light fixture (38) that incorporates the same components as the light assembly (10) used within a fluorescent light fixture as described above. The LED night light assembly of FIG. 15, in accordance with the present invention, and used within the recess light fixture utilizes a specially designed one piece assembly that allows the light assembly to fit easily within a conventional recess light fixture (38). As with the first light assembly, the night light assembly requires no connection wiring to the recessed light fixture and also like the fluorescent fixture, it is easy to install. Furthermore, the LED night light assembly of the present invention incurs little if any noticeable impact on lighting fixture design or room décor and is economical to manufacture. The LED lights of the assembly of FIG. 15 may be located within a cove, with reflective sides (34) and the means to direct the LED lights (35) downward.

FIG. **16*a*-16*e* illustrates another embodiment of the present invention of a LED light assembly (10) being installed within a lamp fixture (41*a*), also having the same components photovoltaic cells (45), light sensor (46), battery (43), and LED light source (44). The operation is the same as described for the other embodiments. The LED light assembly (10) is designed around the lampshade framing (47) and fits over the lamp holder socket (41*b*) within lamp fixture (41*a***). As with the other embodiments, the LED light assembly requires no connection wiring or switches to turn on or off the light assembly. The LED light assembly, like the other embodiments, generates its own power to operate the LED's as a night light.

Figure 17:
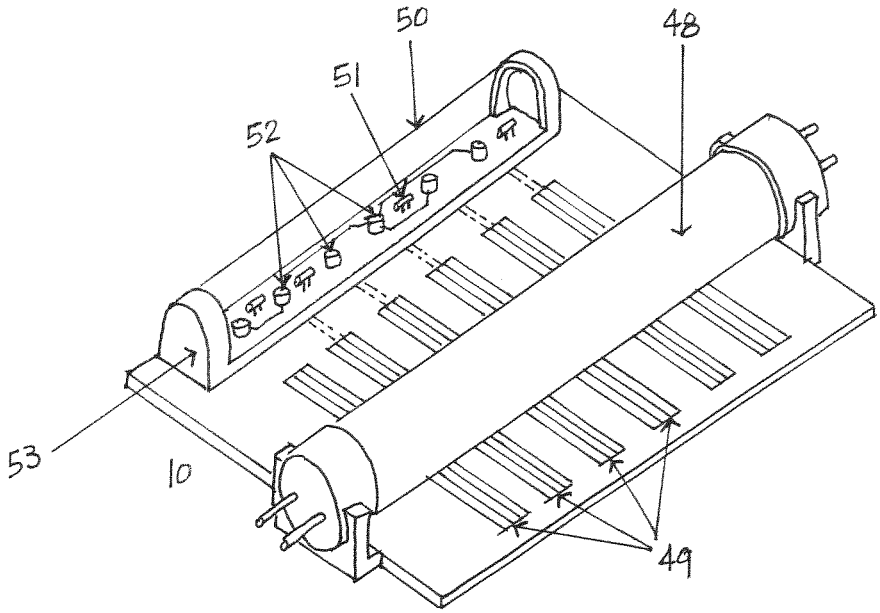
FIG. 17 illustrates a perspective view of another embodiment of a light assembly in accordance with the present invention.
Figure 18:
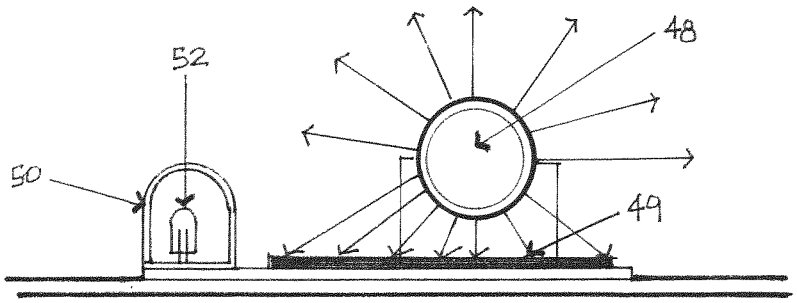
FIG. 18 illustrates a cross-section of another embodiment of a light assembly in accordance with the present invention.

FIGS. 17 and 18 illustrates another embodiment of the present invention of a simple light assembly (10) that slides under a fluorescent tube (48) to capture the light and convert it into electrical current to directly power one or more LED lights (52) at the same time the fluorescent light (48) is in operation or not in operation. The LED's are located within a tube (53) that features a transparent cover (50). The light assembly (10) would be the source of generating additional light within a light fixture without the need of using any batteries, more importantly the cost to operate the LED's and the means of increasing the light is "zero". Testing of the present invention indicates the ability of powering LED's directly, without batteries, and the means of increasing the light source within a light fixture. The increase in light will be based on the amount of photovoltaic cells used. The more photovoltaic cells used, the more light generated.

Figure 19:
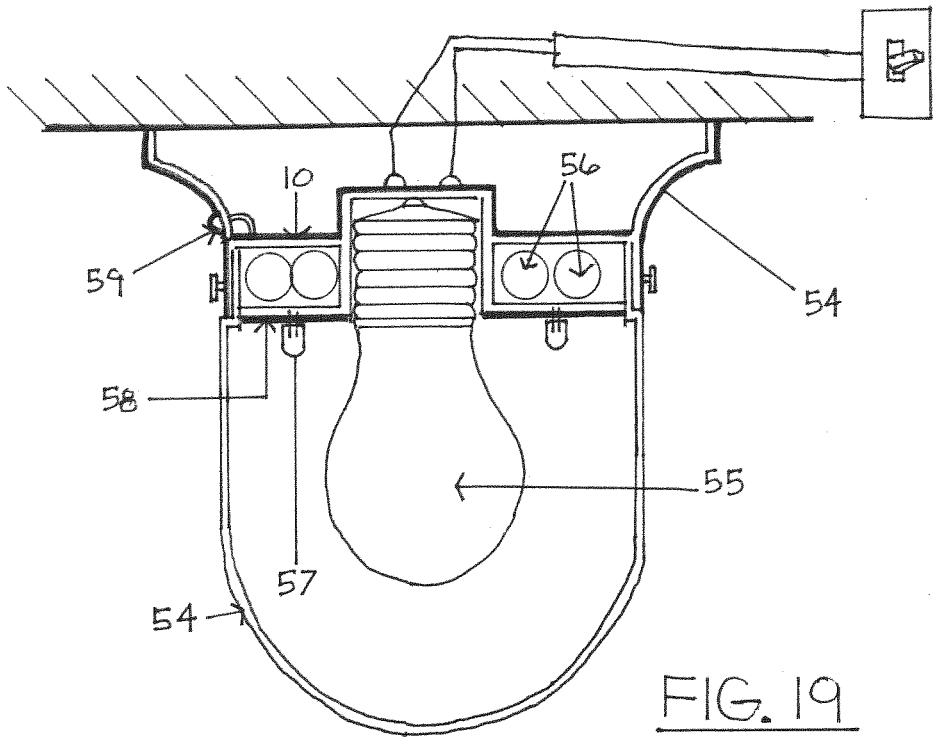
FIG. 19 illustrates a cross-section of another embodiment of a light assembly in accordance with the present invention.
Figure 20:
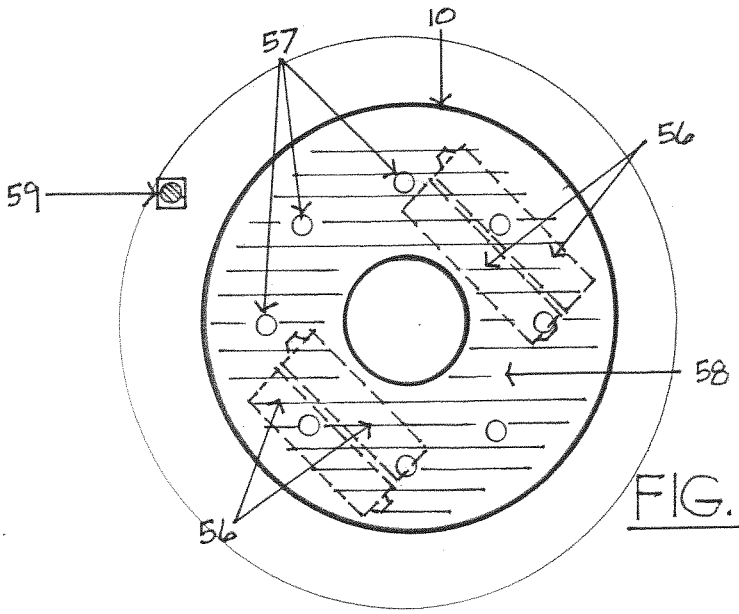
FIG. 20 illustrates a top view of another embodiment of a light assembly in accordance with the present invention.
Figure 21:
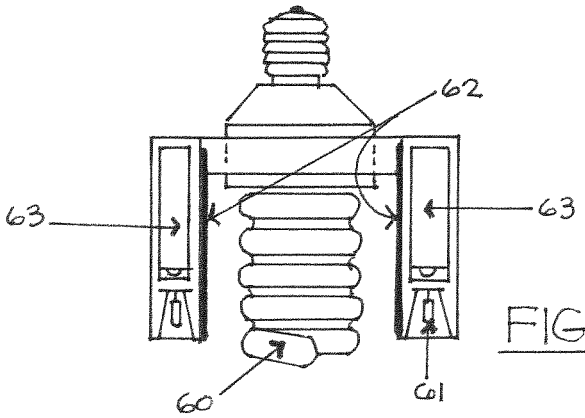
FIG. 21-24 illustrates a section view, perspective, and top view of a spotlight assembly in accordance with the present invention.
Figure 22:
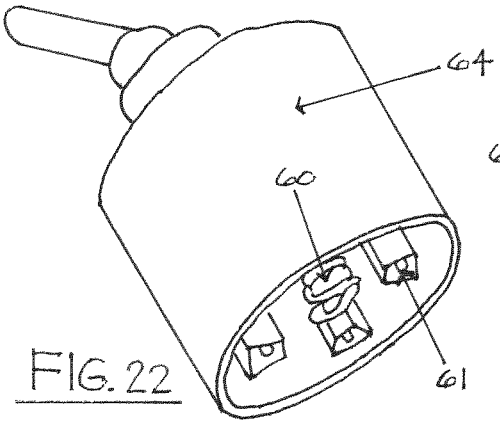
Figure 23:
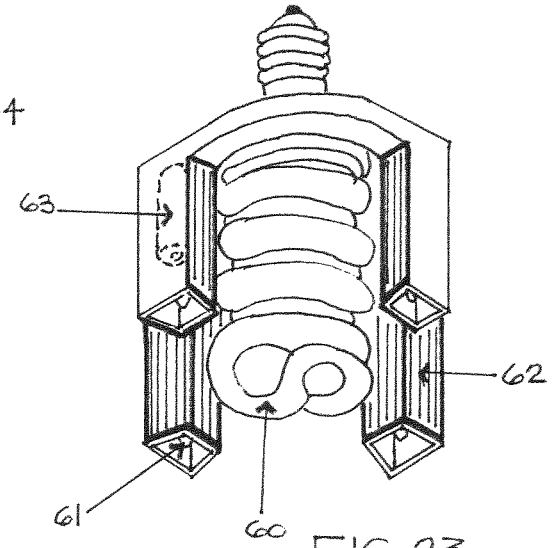
Figure 24:
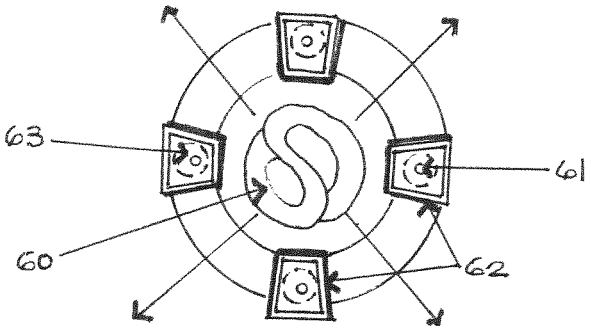
Figure 26:
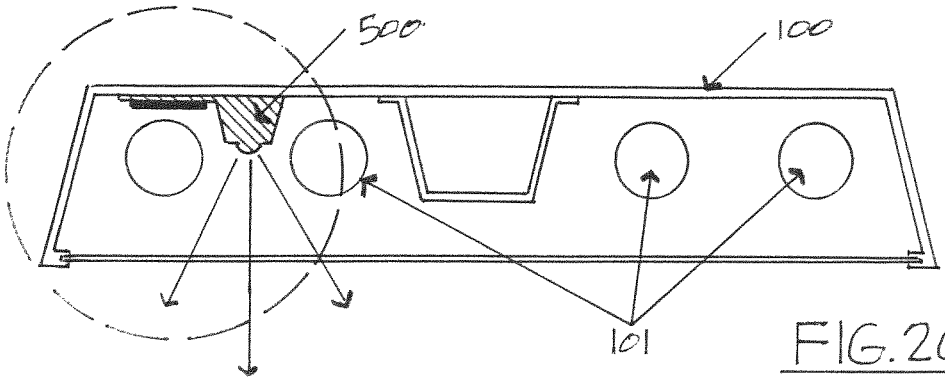
FIG. 26 illustrates a cross-sectional end view of a portion of the light assembly shown in FIG. 25.
Figure 27:
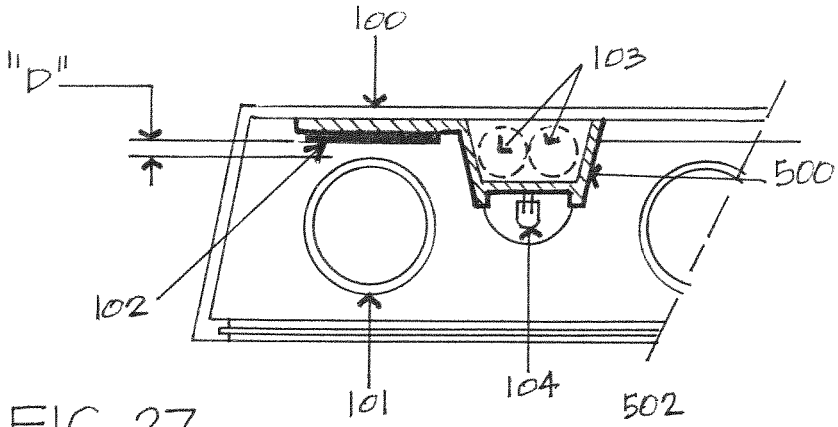
FIG. 27 illustrates an enlarged cross-sectional view of the portion of the light assembly shown in FIG. 26.

FIGS. 19 and 20 illustrates another embodiment of the present invention in that of a conventional ceiling light fixture. The present invention of a LED light assembly (10) that fits into a ceiling light (54), requiring no connections to the light fixture. This incorporates the same components within the light assembly, using LED (57) as the light source, photovoltaic cells (58) to charge one or more batteries (56), a photocell (59) to turn on and off the light assembly, circuitry (not shown) to operate the LED and a charge pump converter (not shown) to help improve efficiency and improve battery life. These are all within the present invention and the conventional ceiling light fixture, creating a light assembly that has no energy cost to operate.

FIG. 21-24 illustrates a LED light assembly that attaches to a light bulb assembly. This specially design LED light assembly features photovoltaic cells (62), batteries (63), and LED's within a light assembly that attaches to another light assembly and operates as a spot light "night-light" designed to easily fit within a recess fixture or spot light fixture.

FIGS. 25-29 show other embodiments 500 of an LED light assembly which can be incorporated into or otherwise operatively coupled to a new or existing fluorescent light fixture 100 to provide, for example, a night-light function and/or an emergency light function. Power for both functions may be obtained from at least one rechargeable battery 103.

In the embodiments shown in FIGS. 25-29, light assembly 500 is positioned and secured within a housing 100 of a fluorescent light fixture. light assembly 500 may be secured within a housing of fixture 100 by, for example, magnets attaching the light assembly to a surface of the housing. However, other methods of attachment (such as fasteners or adhesives) may also be used.

In one embodiment, light assembly 500 includes a housing 502, at least one LED 104 coupled to the housing 502, at least one photovoltaic cell 102 coupled to housing 502, at least one rechargeable battery 103 positioned in (or coupled to) the housing 502 and electrically coupled to photovoltaic cell(s) 102 and to LED's 104, a leakage prevention circuit 506 positioned along a current flow path between the battery (or batteries) 103 and photovoltaic cell(s) 102, and a switch 508 positioned along a current flow path between the batteries 103 and LED's 104. Housing 502 may be formed from any suitable material. Photovoltaic cells 102 receive light from fluorescent bulbs 101 which is converted into electrical current to charge batteries 103. LED 104 may comprise a single LED, a bank of electrically connected LED's (such as a changeable LED strip), or any other suitable arrangement of LED's. Leakage prevention circuit 506 may include diodes and/or any other circuit elements configured for preventing leakage or flow of current from batteries 103 to photovoltaic cell(s) 102 after the batteries have been charged. Switch 508 is configured to actuate to enable and prevent a flow of power from batteries 103 to LED's 104 upon receipt of a suitable actuation signal.

Figure 25:
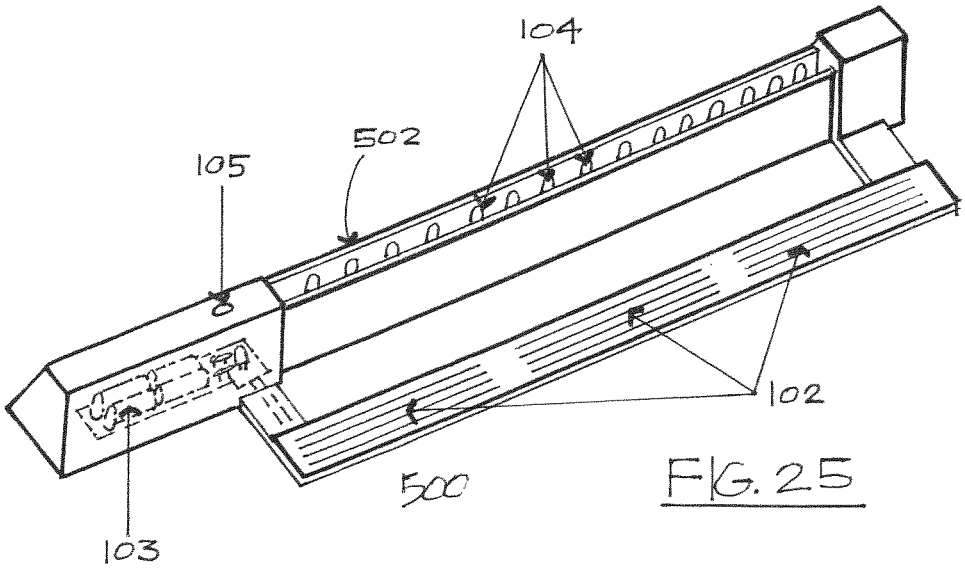
FIG. 25 illustrates a perspective view of a light assembly in accordance with another embodiment of the present invention.

Located within the fluorescent light fixture 100 shown in FIG. 25 are one or more fluorescent bulbs 101. During operation, bulbs 101 will generate light or ultra violet rays that will be captured by the photovoltaic cells 102 and converted into electrical current. The photovoltaic cells 102 in the embodiments of the present invention are positioned with respect to the fluorescent bulbs 101 so as to aid in preventing obstruction of the light being transmitted from the bulbs 101 to the cells 102. The photovoltaic cells 102 adjacent an associated bulb 101 are positioned at a distance D from the bulb, as seen in FIG. 2. In a particular embodiment, the distance D is within the range of ¼ inch-2 inches, to aid in maximizing the amount of light captured by the photovoltaic cells 102. When the light strikes the photovoltaic cells, electrons are dislodged, producing electricity that can be conveyed to and stored within at least one rechargeable battery 103 and used at a later time to operate the LED's 104 of an LED light assembly. DC power may be supplied by batteries 103 directly to the LED's 104 by way of suitable transmission and control circuitry.

Figure 28:
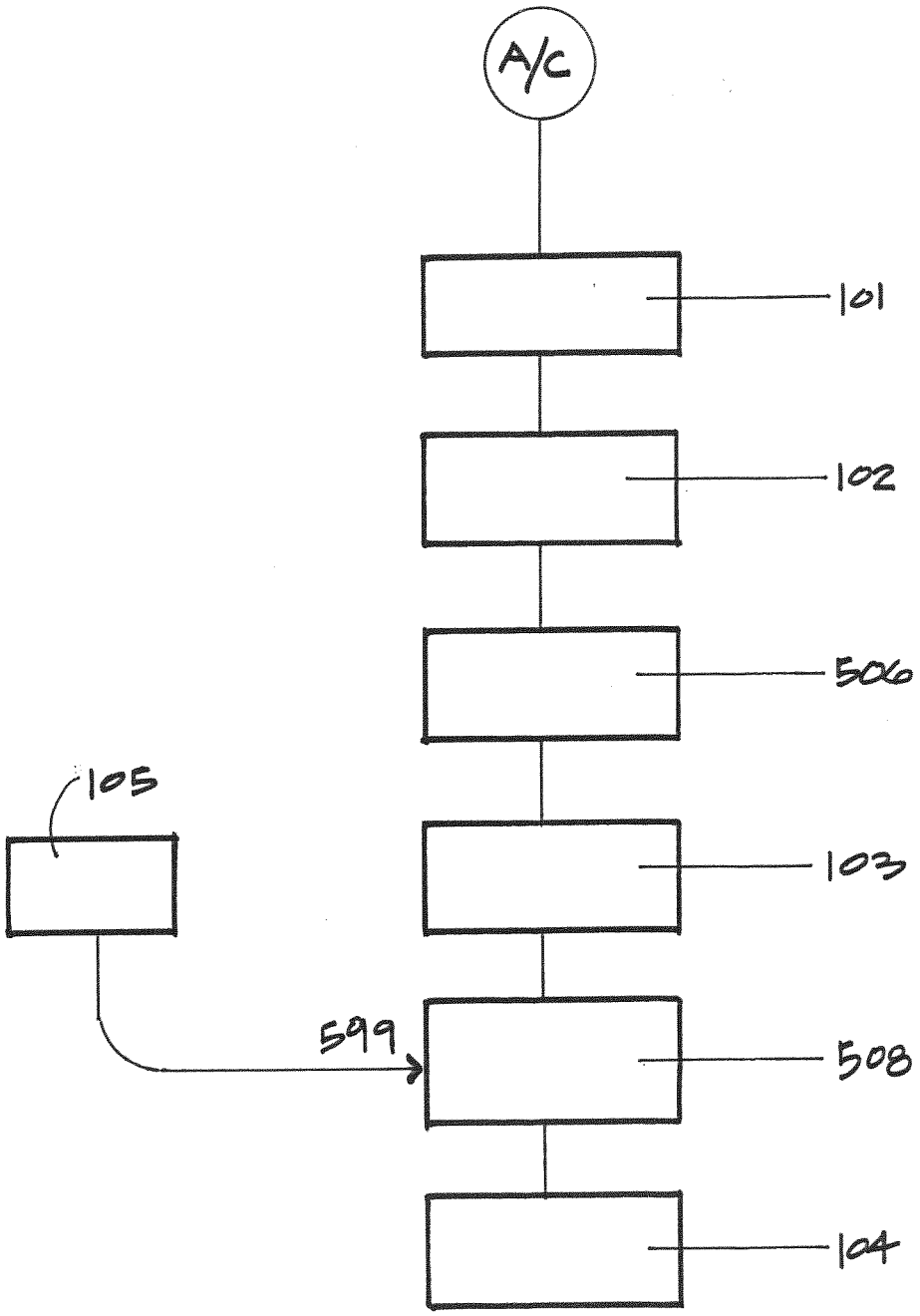
FIG. 28 is a flow diagram showing an operational mode of a light assembly in accordance with one embodiment of the present invention.

Referring to FIGS. 25 and 28, in one particular embodiment, a separate photovoltaic cell or suitable ambient light sensor 105 may be provided for sensing a reduction in ambient light around the fluorescent light fixture. When the photovoltaic cell 105 detects that the level of ambient light has fallen to a predetermined value, an actuation signal 599 is provided to switch 508. In this embodiment, switch 508 is configured to actuate to enable a flow of current from batteries 103 to one or more of LED's 104 responsive to the actuation signal. In this operational mode, the light assembly 500 may operate as a night light.

Figure 29:
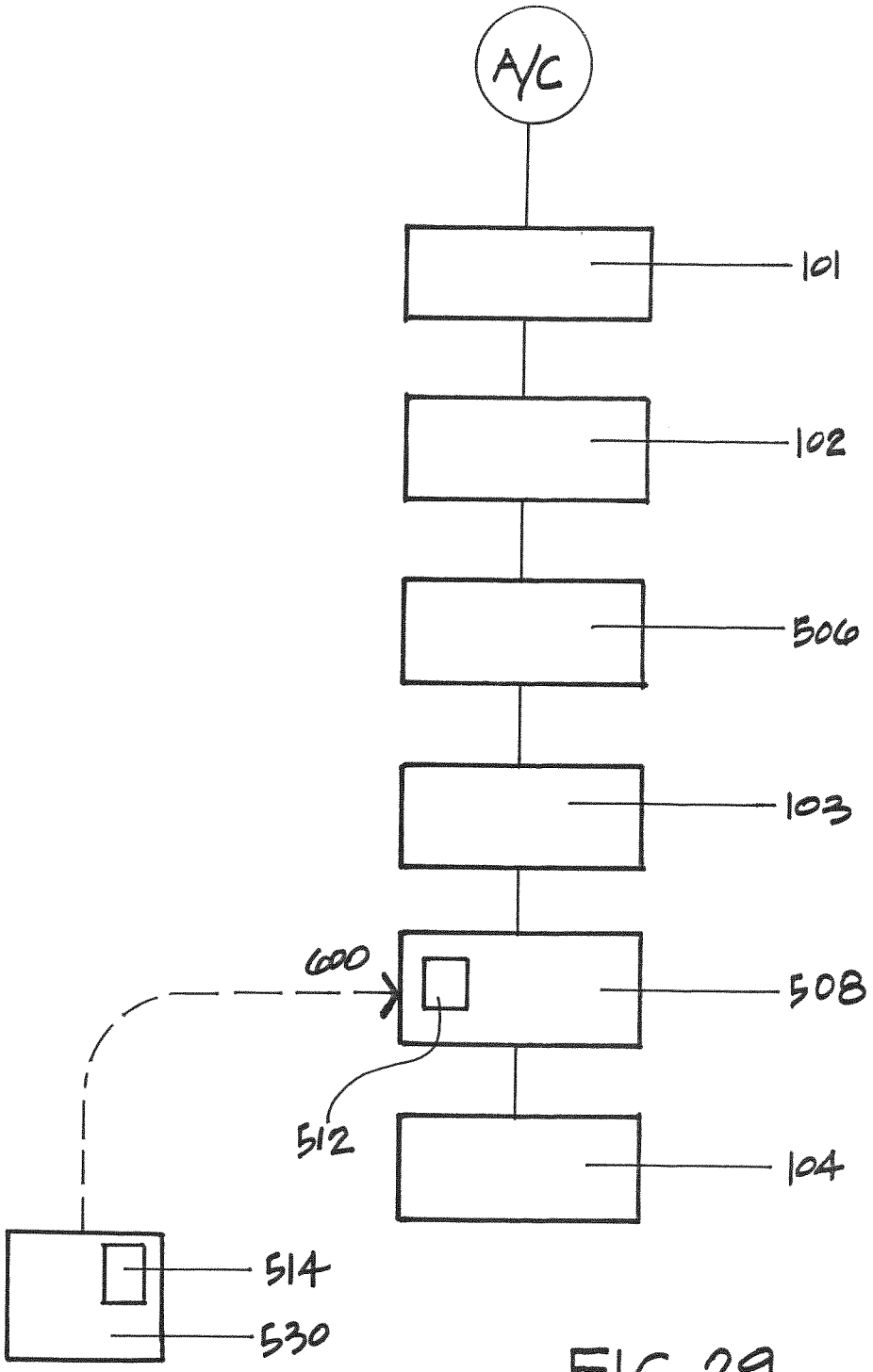
FIG. 29 is a flow diagram showing an operational mode of a light assembly in accordance with another embodiment of the present invention.

Referring to FIG. 29, in another particular embodiment, switch 508 is configured to receive an actuation signal responsive to a power outage or other interruption in the normal flow of alternating current (A/C) supplied to the fluorescent lighting fixture. In one particular embodiment, switch 508 includes an RF receiver 512 or another suitable means for receiving an RF signal from a suitable transmitter 514 located in (or operatively coupled to) an electrical service, junction box, or other power flow control mechanism 530 which controls or monitors the flow of A/C power to the fluorescent lighting fixture. Other methods may also be used for generating a suitable actuation signal. When A/C power to the fluorescent light fixture is interrupted, the actuation signal 600 is provided to switch 508. In this embodiment, switch 508 is configured to actuate to enable a flow of current from batteries 103 to one or more of LED's 104 responsive to the actuation signal. In this operational mode, the light assembly 500 may operate as an emergency lighting system.

In another particular embodiment, switch 508 is configured to actuate responsive to either of the "low ambient light level" signal or the "power interruption" signals described above. In this operational mode, the unit may function and both a night light and an emergency light.

Again with reference to the drawings, in which similar reference characters denote similar elements throughout the several views, the figures illustrate the concealed safety lighting device of the present invention.

It will be appreciated that the present invention and embodiments described herein are manufactured with components provided in the art, as off-the-shelf items. The present combinations have heretofore not been appreciated. The components are wired to affect power distribution from the lighting to the lights in a known way. In accordance with the present invention, and as shown in the drawings, the batteries may be connected to the conventional lighting, or to LED lighting thereby providing efficient and economic lighting as described herein.

It will be understood that the foregoing descriptions of embodiments of the present invention are for illustrative purposes only and are not meant to limit any of the embodiments or components of the embodiments. As such, the various structural and operational features herein disclosed are susceptible to a number of modifications commensurate with the abilities of one of ordinary skill in the art, none of which departs from the various permutations described herein. Nevertheless, the novelty of capturing energy to power a light assembly could be provided for any number of differently designed light fixtures so long as each light fixture is also fitted with a solid state lighting device such as an incandescent or fluorescent bulb functioning as the primary light source. Further, a light assembly of the present invention also incorporates one or more photovoltaic cells to capture the light and to convert it into electric current, a battery to store energy to operate one or more LED's, a light sensor to turn on and off the LED's, the circuitry needed to operate the of LED's within the light assembly, an optional charge pump converter to improve the operational efficiency of the light assembly and as in many cases, reflectors to help reflect the primary light and the LED's within the light assembly.

In addition, the principle of capturing energy to power an emergency light assembly or a night light assembly could be provided for any number of differently designed light fixtures so long as each light fixture is fitted with a primary light source, a photovoltaic cell to capture the light and to convert it into electric current, a battery rechargeable by the generated current to store the energy to operate one or more LED's (for example, a single LED, a bank of electrically connected LED's (such as a changeable LED strip), or any other suitable arrangement of LED's), a circuit or other mechanism configured to prevent leakage of current from the charged battery or batteries, and any associated circuitry (if required) for controlling transmission of power from the batteries to the LED's.

What is claimed is:

1. A light assembly comprising:

a troffer;

at least one fluorescent tube;

at least one photovoltaic cell operatively communicating with and adjacent to said at least one fluorescent tube;

at least one battery pack electronically communicating with said at least one photovoltaic cell;

at least one light emitting diode electronically communicating with said battery pack; and at least one actuation sensor operatively communicating with said battery pack, wherein said actuation sensor initiates electronic communication between said battery pack and said at least one light emitting diode.

2. The light assembly of claim 1 wherein said at least one photovoltaic cell is spaced less than one inch from said at least one fluorescent tube.

3. The light assembly of claim 1 wherein said at least one photovoltaic cell is spaced no more than 0.25 inches from said at least one fluorescent tube.

4. A light assembly comprising:

a troffer, a plurality of fluorescent tubes;

at least one photovoltaic cell operatively communicating with and adjacent to said plurality of fluorescent tubes;

at least one battery pack electronically communicating with said at least one photovoltaic cell;

a plurality of light emitting diodes electronically communicating with said battery pack; and a photo-cell sensor operatively communicating with said at least one battery pack, wherein said photo-sensor is operable to initiate electronic communication between said battery pack and said plurality of light emitting diodes.

5. The light assembly of claim 4 wherein said at least one photovoltaic cell comprises a plurality of photovoltaic cells, each one of said plurality of photovoltaic cells corresponding to and operatively communicating with a respective fluorescent tube of said plurality of fluorescent tubes.

6. A light assembly comprising:

a housing;

a plurality of fluorescent tubes;

a plurality of photovoltaic cells, each of said photovoltaic cells corresponding to one of said fluorescent tubes;

at least one battery pack electronically communicating with said plurality of fluorescent tubes;

at least one light emitting diode electronically communicating with said battery pack; and at least one actuation sensor operatively communicating with said battery pack, wherein said actuation sensor initiates electronic communication between said battery pack and said at least one light emitting diode.

7. The light assembly of claim 6 further comprising:

a plurality of battery packs, each of said battery packs electronically communicating with said plurality of photovoltaic cells.

* * * * *

UNITED STATES PATENT AND TRADEMARK OFFICE

CERTIFICATE OF CORRECTION

PATENT NO. : 8,628,209 B2
APPLICATION NO. : 12/955880
DATED : January 14, 2014
INVENTOR(S) : Shew It is certified that error appears in the above-identified patent and that said Letters Patent is hereby corrected as shown below:

In the Specifications

Column 7; Line 18; Please delete "light" and insert --Light--.

Column 8; Line 30; Please delete "and" and insert --as--.

Column 8; Line 63; Please delete "of".

Signed and Sealed this
Twenty-fifth Day of March, 2014

Michelle K. Lee

Michelle K. Lee
*Deputy Director of the United States Patent and Trademark Office*